United States Patent [19]

Ushakov et al.

[11] 4,300,949

[45] Nov. 17, 1981

Best Available Copy

[54] METHOD FOR TREATING SULFIDE RAW MATERIALS

[76] Inventors: Konstantin I. Ushakov, Maly Demidovsky pereulok, 3, kv. 95, Moscow; Mikhail E. Khilko, ulitsa Sovetskaya, 26, kv. 4, Mednogorsk Orenburgskoi oblasti; Rina I. Felman, Yaroslavskaya ulitsa, 1/9, kv. 48, Moscow; Vasily I. Sadykov, ulitsa Tikhomirova, 7/3, kv. 143, Moscow; Evgeny I. Kalnin, ulitsa Chertanovskaya, 13, kv. 46, Moscow; Pavel A. Kovgan, Izmailovsky bulvar, 40/14, kv. 27, Moscow, all of U.S.S.R.

[21] Appl. No.: 129,013

[22] Filed: Mar. 7, 1980

[51] Int. Cl.[3] ..... C22B 15/00

[52] U.S. Cl. ..... 75/73; 75/23

[58] Field of Search ..... 75/73–75, 75/21, 23

[56] References Cited

U.S. PATENT DOCUMENTS

| | | | |
|---|---|---|---|
| 3,281,236 | 10/1966 | Meissner | 75/73 |
| 3,890,139 | 6/1975 | Suzuki | 75/73 |
| 3,990,889 | 11/1976 | Queneau | 75/74 |

*Primary Examiner*—P. D. Rosenberg

*Attorney, Agent, or Firm*—Steinberg & Raskin

[57] ABSTRACT

The present invention relates to the field of non-ferrous metallurgy and more specifically to methods for treating sulfide raw materials.

The method comprises an autogenous smelting of the raw materials with flux additions in a blast furnace, where a quartz layer 0.3 to 1.5 m high is provided immediately above the tuyeres of the furnace. The smelting process is conducted with oxygen-enriched air blowing with an oxygen consumption of 300 to 400 $m^3$/tonne of sulfide material. The smelting method produces matte suitable for subsequent converting, elemental sulfur, and off-gases containing 8 to 25% $SO_2$.

The method can be applied for copper and copper-nickel production.

5 Claims, No Drawings

METHOD FOR TREATING SULFIDE RAW MATERIALS

THE FIELD OF TECHNOLOGY

The present invention relates to the field of non-ferrous metallurgy and more specifically to a method for treating sulfide raw materials.

The treatment of sulfide raw materials is aimed at recovery of metals and sulfur therefrom. Sulfide raw materials include ores, for instance, copper, copper-zinc, copper-nickel ores, concentrates and intermediate products of ore beneficiation.

BACKGROUND OF THE INVENTION

Treatment of sulfide raw materials implies direct recovery of metal therefrom or recovery of metal into a matte that is then converted for production of metal or enriched sulfide phase (e.g. copper-and-nickel converter matte produced by smelting copper-nickel raw materials) from which metals are recovered by subsequent processing. Direct recovery of metal, in particular copper, from sulfide raw materials is accomplished in a single unit or in a number of units for continuous smelting process in series. The known methods for continuous smelting have, however, until now not come to extensive commercial use. In the practice of non-ferrous extractive metallurgy, methods are primarily in use implying the recovery of metals in the form of matte, from which metals are produced by subsequent processing.

The known methods for treating sulfide raw materials to produce matte include smelting of raw materials in blast, reverberatory, electric and flash smelting furnaces.

The blast furnace smelting requires a charge containing raw material and flux, the use of a carbonaceous fuel, mainly coke, and oxygen-containing gas blowing. All the known methods for smelting sulfide raw materials in blast furnaces involve the use of carbonaceous fuel.

Depending on the compositions of the initial raw material and of the produced products, the methods for sulfide raw material treatment in blast furnaces are divided into pure pyrite smelting, partial pyrite smelting and copper-and-sulfur smelting (Orkla process).

To treat massive pyritic copper ores (i.e. ores with a low gangue content) containing at least 32% sulfur, pure pyrite smelting was used. This method involved smelting of a charge, consisting of ore with flux (quartz and limestone) additions and up to 3% wt. of coke, in a blast furnace with an open throat and with air blowing at a rate of about 1,000 to 1,200 $m^3$/tonne of ore. The oxygen consumption amounts to about 210 to 250 $m^3$/tonne of ore. During smelting, copper is recovered into matte, sulfur passes into off-gases (Smirnov V. I. Metallurgy of copper and nickel, Sverdlovsk-Moscow, Metallurgizdat, 1950, p. 176–255, and in particular p. 188, 195, 200, 252; Peters E. D. The Practice of Copper Smelting, New York, McGraw-Hill Book Company, 1911, p. 204–242, and in particular p. 236).

This method provided a high rate of desulfurization (up to 95%) and a high rate of concentration (up to 20–25:1). The concentration ratio is the relationship between the copper content in matte and the copper content in initial raw material. However, the pure pyrite smelting process was difficult to control because of an unstable heat balance and because of a long time required for the charge to pass through the furnace. Furthermore, fuel required for the process operation was expensive coke in an amount of up to 2.5–3% of the total charge weight. Some attempts were made to implement the pure pyrite smelting without coke additions, i.e. autogenously, but no positive results were attained if the process had to be conducted for a longer (several days) period (Sticht R. S. Über das Wesen des Pyrit-Schmelzverfahrens, Halle, Wilhelm Knapp, Metallurgie, May 1906, N 9, S. 269). It should be noted that during the pure pyrite smelting process sulfur was normally lost with off-gases and had to be emitted into the atmosphere, whereby the environment was contaminated. This process was in common use at the beginning of the 20th century, but later a change over to partial pyrite smelting was done due to a gradual exhaustion of massive copper pyrite ore deposits.

The partial pyrite smelting is conducted on copper pyrite ore and/or lump-size concentrates, containing less than 32% sulfur. This method implies smelting of a charge that consists of ore and/or concentrates with flux additions and of up to 12.5% wt. carbonaceous fuel, usually coke, in a blast furnace with an open or sealed throat and an air or oxygen-enriched blowing.

The use of other carbonaceous fuels, e.g. pulverized coal, fuel oil, or natural gas, introduced through the tuyeres or the use of them in the form of combustion on products fed above the tuyeres, allows one to reduce the consumption of expensive coke to a certain extent, but does not completely eliminate its use.

The air blow rate amounts up to 1,500 $m^3$/tonne of sulfide raw material or even more, while the oxygen-enriched blow rate is about 775 to 1,215 $m^3$/tonne of sulfide material. The actual oxygen requirement for smelting one tonne of sulfide raw material, taking into account oxygen needed for coke combustion, does not exceed 150 $m^3$. During smelting, copper is recovered into matte, sulfur transfers into off-gas (Smirnov V. I. Metallurgy of Copper and Nickel, Sverdlovsk-Moskow, Metallurgizdat, 1950, p. 199–211, and in particular p. 200 a. 252; Lebedev N. I. et al., Copper blast smelting with oxygen-enriched blowing, "Tsvetnyey metally", 1961, N 3, p. 32–39).

The partial pyrite smelting process provides a lower, as compared to the pure pyrite smelting, extent of desulfurization (up to 75%), a lower ratio of concentration (up to 4–5:1) and a low $SO_2$ content (2 to 5%) of the off-gas, which makes it difficult to recover sulfur therefrom. Furthermore, this method involves a higher consumption of expensive and short-of-supply coke as a heat source. The use of oxygen-enriched blowing allows the cutting down of the coke requirements, but by no more than 30%.

The partial pyrite smelting process is also applied for treating copper-nickel sulfide ores and/or concentrates of pyrrhotite type providing a desulfurization rate of up to 50 to 65%. When smelting such raw material and using oxygen-enriched blowing, the coke consumption decreases, but by no more than 40%, and is maintained at about 5.8% of the charge weight (Biswas A., Davenport W. Extractive Metallurgy of Copper, Oxford, Pergamon Press, 1976, p. 100–109).

During the 1930s the so-called copper-and-sulfur process (Orkla method) was developed for smelting sulfide raw materials. This method is used to treat copper pyrite ores with a sulfur content of 40 to 45%. This process involves smelting a charge, consisting of ore and fluxes with addition of solid carbonaceous material, e.g. coke, in an amount of 10% of the total charge weight, in a blast furnace with a sealed throat. The smelting process is accomplished with air blowing at a rate of up to 1,000 $m^3$/tonne of ore, and the oxygen consumption herewith amounts to 210 $m^3$/tonne of ore. The actual oxygen requirement is even lower because some oxygen of the blow air is used for combustion of a part of the coke that plays a role of fuel in the smelting process. Another part of coke burns in the middle zone of the furnace to provide reduction of $SO_2$ formed as a result of FeS oxidation in the bottom zone of the furnace. The products of the smelting process are matte, slag, elemental sulfur and sulfur-bearing gases, from which additional elemental sulfur is recovered in the presence of a catalyst (U.S. Pat. No. 1,860,585, Cl. 23-226, May 31, 1932).

This method provides a sufficiently high sulfur recovery in the form of elemental sulfur from sulfide materials, which is a substantial advantage in comparison to other methods. On the other hand, this method shows a low desulfurization rate (up to 85%) and a low rate of concentration (up to 5.5:1). As a result, treatment of ores, containing, for example, 2.5% copper, yields low-grade mattes, containing 8 to 10% and a maximum of 14 to 15% copper. Prior to converting, such mattes should be subjected to additional treatment in an upgrading smelting furnace (concentration smelting) and this increases the cost of raw material processing. This process also requires the use of coke, not only as a reductant for recovery of sulfur from $SO_2$, but also as fuel. Furthermore, this process is hard to control, because it takes a long time for the charge to pass through the furnace. Sulfur-bearing gases, after a catalytic treatment, have to be discharged into the atmosphere because sulfur is difficult to recover therefrom.

OBJECTS OF THE INVENTION

The main objects of the invention are to improve the sulfide raw materials treatment in blast furnaces, and to reduce the costs of raw material processing, and to increase the sulfur recovery therefrom.

SUMMARY OF THE INVENTION

The objects of the said invention are attained by using a method for treating sulfide raw materials in a blast furnace, the said method comprising the smelting of a charge, consisting of metal-bearing raw material and fluxes, with oxygen-containing gas blowing to produce matte, slag, elemental sulfur and sulfur-bearing off-gas. The particular feature of the said method is that the charge smelting is conducted autogenously in a furnace with a quartz layer 0.3 to 1.5 m high immediately above the tuyeres, which allows the maintaining of a desired amount of charge to be smelted as per 1 $m^2$ of the furnace cross section within the tuyere zone and per unit of time and to ensure a sufficiently complete oxidation of iron sulfide, that forms as a result of higher sulfides contained in the initial raw material, by the oxygen supplied with oxygen-enriched air blowing with an oxygen consumption rate of 300 to 400 $m^3$/tonne of sulfide raw material.

As the sulfide raw material treatment is accomplished autogenously, i.e. without use of coke or any other carbonaceous fuel, the cost of the process is substantially lower. This is a major merit of the invention.

The method allows one to produce high-grade mattes in a single step and to increase the sulfur recovery from the raw material.

The advantages of the invention include also its applicability to a wide variety of sulfide raw materials, for example, copper, copper-zinc, and copper-nickel ores, lump-size copper, pyrite, and pyrrhotite concentrates, and intermediate products. The merits of the said invention will be illustrated by the following detailed description.

DETAILED DESCRIPTION OF THE INVENTION

The method for treating sulfide raw materials comprises smelting of a charge, consisting of raw material and fluxes in a blast furnace, where a quartz layer 0.3 to 1.5 m high is provided immediately above the tuyeres. Through the tuyeres, oxygen-enriched air is supplied into the furnace. The oxygen requirement amounts to 300 to 400 $m^3$/tonne of sulfide raw material.

When testing the smelting process with oxygen-enriched air blowing, it was found that the consumption of coke as fuel can be reduced. Complete elimination of the use of coke as fuel, however, can be achieved, as it was found, only when the mentioned features of the invention, i.e. the above mentioned height of the quartz layer and the specified oxygen requirement, are provided.

The method for processing sulfide raw materials is accomplished in a blast furnace of a common design with a hermetically sealed throat used for non-ferrous metal production. The charge consisting of sulfide ore and/or lump-size sulfide materials (e.q. briquetted concentrate) and fluxes (quartz and limestone) is fed into the furnace through a charging device ensuring hermeticity. Individual components of the charge are in the form of lumps, preferably of not too large a size—not more than 100–120 mm. To provide the required gaseous impermeability of the charge within the furnace the share of the fraction size minus 20 mm should not exceed 5 to 10%. It is preferable to mix components of the charge prior to its loading into the furnace, but it is also possible to introduce them into the furnace in individual layers.

The charge smelting is conducted in a furnace where a quartz layer 0.3 to 1.5 m high is provided immediately above the tuyeres. The term "quartz layer" should be understood as a bed consisting primarily of quartz, as well as of a small amount of limestone, slag, and sulfides. Initially, the furnace can be put into operation by any of the common methods, and, when the furnace is about to reach the normal smelting conditions, a quartz layer of the indicated height is provided by feeding and smelting a charge containing an excess amount of quartz in comparison to the calculated quartz content in the normal working charge. The total amount of quartz to be introduced into the furnace, when it is nearing the normal smelting conditions to provide a quartz layer of a specified height, is calculated on the basis of the cross sectional area and the bulk weight of quartz. The height of the quartz layer should be within a range of 0.3 to 1.5 m. These values are chosen because, when the quartz layer is less than 0.3 m, the ratio of concentration decreases below the required level, and when the quartz layer is more than 1.5 m thick, the normal process operation is disturbed.

In accordance with the invention the sulfide material smelting is conducted with oxygen-enriched air blowing introduced into the furnace through tuyeres. The blow rate is 900 to 1,200 $m^3$/tonne of sulfide raw material. The oxygen content in the blow is 25 to 45%. With an oxygen consumption of less than 300 $m^3$/tonne of sulfide raw material, low grade matte is produced, and if the oxygen consumption is increased to over 400 $m^3$/tonne of sulfide raw material, there would be an excess of oxygen that is not desirable, because at the higher levels of the furnace it oxidizes elemental sulfur, formed as a result of higher sulfide dissociation, whereby the normal process conditions are disturbed. The recovery of elemental sulfur is therefore lower.

Liquid products obtained as a result of the smelting process are separated in a forehearth into matte and slag. The off-gases leaving the furnace are subjected to dust collection and transferred into a condenser for the recovery of elemental sulfur. After the separation of elemental sulfur the off-gases can be utilized for sulfuric acid manufacture or for additional recovery of elemental sulfur by the means of $SO_2$ reduction. The desulfurization rate reaches 95% during the smelting. The recovery of elemental sulfur, when smelting pyritic ores amounts up to 45%. Using the method, a ratio of concentration of 30:1 can be achieved. This means that even smelting low-grade ores (for example, copper ores with a copper content of 1.5 to 2%) can produce high-grade matte (25 to 40% copper) that does not require additional smelting prior to the converting; in other words, the produced matte is transferred directly for further processing in converters. Slags obtained as a result of treating sulfide raw materials by the said method are normally considered to be discard slags. A characteristic feature of produced slags is the fact that they have practically no or a very low (up to 5%) content of magnetite. When smelting copper-zinc material, the obtained slag can be used for the recovery of zinc therefrom, for example, by slag-fuming method. Slags obtained when smelting copper-nickel material can be subjected to slag-cleaning, for example, in an electric furnace.

High process values could be attained by virtue of the oxygen-enriched air blowing with oxygen consumption within the specified range. The quartz layer of an appropriate height prevents an excessive increase of the smelting productivity and it thereby contributes to the higher ratio of concentration due to the intensification of the iron sulfide oxidation by oxygen in the air blow in the presence of quartz.

By virtue of the nature of the invention, malfunctions of the smelting process can be readily corrected by controlling the oxygen consumption which should be maintained within the specified range.

In one of the embodiments of the invention a carbonaceous reductant, e.g. natural gas, coke, fuel oil, or another suitable reductant, is introduced into the blast furnace to improve the elemental sulfur recovery. In the reduction zone of the furnace, $SO_2$ formed in the oxidizing zone as a result of iron sulfide oxidation on the quartz layer is reduced to elemental sulfur. As has been stated, there is paractically no oxygen in the zone where reductant is introduced, because oxygen has been consumed in the oxidation zone. If natural gas is used as reductant, its consumption is 60 to 70 $m^3$/tonne of sulfide raw material and it should be supplied into the furnace at a rate of 36 to 73 m/sec. Gas is supplied through nozzles located above the tuyeres into a zone where practically no oxygen is present, because it has been completely spent to react with iron sulfide. Therefore, combustion of natural gas in the furnace cannot take place and the process remains autogenous. The mentioned gas injection rate range is determined by the fact that at rates lower than 36 m/sec the recovery of elemental sulfur decreases to some extent, because of a nonuniform distribution of gas throughout the furnace. At rates above 73 m/sec, the recovery of elemental sulfur also decreases because some gas passes through the furnace unreacted. When smelting pyrite-raw material and using natural gas as reductant, the recovery of sulfur in elemental form amounts to 57 to 59%.

When coke, preferably of a size −25 +10 mm, is used as reductant, its consumption is about 6–7% of the total charge weight. Coke is fed into the furnace together with the charge. In this case too the process is autogenous, because the amount of coke is equal to the stoichiometric amount required only for the $SO_2$ reduction. The recovery of sulfur in elemental form, when smelting pyritic raw materials, is 65 to 67%.

The said method can be used for processing various types of sulfide materials, e.g. copper pyrite ores, copper-nickel pyrrhotite ores, copper, pyrite and pyrrhotite concentrates, copper-zinc ores and middlings. On the other hand, the conventional blast furnace smelting processes are not applicable to all types of sulfide materials. Among other things, ores containing over 3% Zn cannot be processed by the copper-and-sulfur smelting process. Moreover, the invention can be applied to low-grade pyritic materials for example, pyrite concentrates, containing precious metals. It provides a sufficiently high recovery of metals into matte. At present, low-grade pyritic raw materials are used for sulfuric acid manufacture, and the precious metals contained report with calcines and are not recovered in most cases, because of high processing costs.

A comparison of the sulfide material smelting method with the conventional copper-and-sulfur smelting, that also provides recovery of metal into matte and recovery of elemental sulfur, shows that the method is commercially superior because it has the following advantages. The process is autogenous, i.e. it does not involve the use of carbonaceous fuel. It allows the saving of 25 to 30 kg of coke per 1 tonne of sulfide material treated. The method allows the treatment of low-grade ores (e.g., ores containing 1.5 to 2% Cu) and produces sufficiently high-grade mattes (25 to 40% Cu) that can be used immediately for converting so that upgrading smelting is eliminated. The total sulfur recovery from pyritic raw materials treated by the method is 85 to 90% or more, and from pyrrhotite materials is 70 to 75% or more. A considerable part of the sulfur is recovered as elemental sulfur. The off-gases after elemental sulfur collection contain from 8 to 25% $SO_2$ and can be used for sulfuric acid manufacture. Thus, sulfur-bearing gas emissions into the atmosphere are practically eliminated. This makes the method advantageous from the point of view of the environment protection as well.

From the mentioned facts it follows that the invention allows one to substantially reduce the costs of sulfide material processing due to the elimination of fuel requirements and upgrading smelting: it ensures a high sulfur recover from sulfide materials and eliminates deleterious emissions into the atmosphere.

For better understanding of the invention some examples of specific embodiments are given.

EXAMPLE 1

The smelting of a charge was conducted in a blast furnace, having a capacity of 70 to 100 tonnes of charge per day, with a hermetically sealed throat, a quartz layer 0.45 to 0.55 m high was provided immediately above the tuyeres. The charge had the following composition (%): copper pyrite ore (1.93% Cu, 41.5% Fe, 46.1% S) 65.8; quartz 23.7; limestone 10.5. The quartz layer was provided when the furnace was about to reach the normal working conditions by feeding charge higher in quartz than the calculated charge composition. The smelting process was conducted blowing air enriched to 28% oxygen. The blow rate was about 1,100 $m^3$/tonne of ore, the oxygen consumption was about 300 $m^3$/tonne of ore. Liquid smelting products were separated into matte and slag in a forehearth. The sulfur-bearing off-gas at a temperature of 380° to 440° C. was transferred, after cleaning, into a condenser for elemental sulfur separation. The recovery of sulfur in elemental form was 41.7%. The desulfurization rate was 90.5%. The off-gas after sulfur condensation contained (%): 22.4 $SO_2$, 0.15 $H_2S$, 0.16 COS, 5.0 $CO_2$, 0.2 CO and 0.9 $O_2$, the balance was nitrogen. Such gas could be utilized for sulfuric acid manufacture or for additional elemental sulfur recovery by reduction. The ratio of concentration was 11.8:1. The product mattes contained 22.8% Cu and were subjected directly to converting for copper recovery. The produced slags contained 0.24% Cu and were discharged. The silica, iron, and calcium oxide contents in the slags were (%): 35–40, 34–39 6–9, respectively; there was practically no magnetite in the slags.

EXAMPLE 2

Smelting of the charge, having the analysis as in Example 1, was conducted in a blast furnace in the same manner as described in Example 1, but the quartz layer height was 1 to 1.2 m; the 33% oxygen-enriched air blow rate was 1,200 $m^3$/tonne of ore, the oxygen consumption herewith was about 400 $m^3$/tonne of ore. The following results were obtained. The desulfurization rate was 95%. The recovery of sulfur in elemental form was about 43.5%. The off-gas had the following analysis (%): 23.3 $SO_2$, 0.21 $H_2S$, 0.23 COS, 5.5 $CO_2$, 0.17 CO and 0.8 $O_2$, the balance was nitrogen. The ratio of concentration during smelting was 30.1:1. The produced mattes contained 58.1% Cu. The produced slags contained 0.6% Cu. As for the rest of the slag constituents, the slag analysis was similar to that in Example 1.

This example illustrates the extensive potential of the process with respect to attaining a high ratio of concentration.

EXAMPLE 3

Smelting of the charge, having the analysis as in Example 1, was conducted in a blast furnace in the same manner as described in Example 1, but the quartz layer height was 0.6 to 0.7 m; the 30% oxygen-enriched air blow rate was about 1,200 $m^3$/tonne of ore, the oxygen consumption herewith was about 360 $m^3$/tonne of ore; to increase the sulfur recovery in the elemtal form, natural gas was introduced into the furnace for reduction of $SO_2$ formed during the smelting process. Natural gas was fed into the furnace through nozzles located at a level of 0.6 m above the tuyeres, where practically no oxygen was present. The natural gas injection rate was 45 m/sec and its consumption amounted to about 63 $m^3$/tonne of ore. The following results were obtained. The desulfurization rate was 92.8%. The sulfur recovery in elemental form was 57.7%. The off-gas had the following analysis (%): 11.6 $SO_2$, 1.33 $H_2S$, 1.4 COS, 9.5 $CO_2$, 1.6 CO, 1.0 $O_2$, 0.76 $H_2$ and 0.97 $CH_4$; the balance was nitrogen. The ratio of concentration was 15.6:1. The product mattes contained 30.1% Cu. The copper content of the produced slags was 0.33%. As for the rest of the slag constituents, the slag analysis was similar to that in Example 1.

EXAMPLE 4

Smelting process was conducted in a blast furnace in the same manner as described in Example 3 with the exception that to improve the sulfur recovery in the elemental form, instead of natural gas, coke was added into the charge in an amount of 6.5% of the total charge weight. The following results were obtained. The desulfurization rate was 92.5%. The sulfur recovery in elemental form was 65.9%. The off-gas had the following analysis (%): 8.9 $SO_2$, 0.31 $H_2S$, 2.2 COS, 13.3 $CO_2$, 1.79 CO, 0.8 $O_2$; the balance was nitrogen. The ratio of concentration was 15.4:1. The produced mattes contained 29.7% Cu. The copper content of the produced slags was 0.31%. As for the rest of the slag constitutents, the slag analysis was similar to that in Example 1.

EXAMPLE 5

Smelting was conducted in a blast furnace of the same capacity, as in Example 1. The initial raw material was copper-zinc pyrite ore, containing 3.55% Cu, 7% Zn, 34.5% Fe and 43.7% S. Into the furnace provided with a quartz layer 0.3 to 0.35 m high, a charge of the following composition (%): copper-zinc ore 71.4, quartz 18.6, limestone 10, was fed. The smelting process was carried out with 32% oxygen-enriched air blowing. The blow rate was 960 $m^3$/tonne of ore, the oxygen consumption herewith was about 300 $m^3$/tonne of ore. The following results were obtained. The desulfurization rate was 88%. The sulfur recovery in elemental form was about 40%. The off-gas had the following analysis (%): 25.2 $SO_2$, 0.1 $H_2S$, 0.1 COS, 6.1 $CO_2$, 0.14 CO and 0.7 $O_2$; the balance was nitrogen. The ratio of copper concentration was 6.8:1. The produced mattes contained 24.1% Cu and 3.5% Zn. The slags, containing 0.28% Cu and 5.5% Zn, can be processed to recover zinc therefrom. As for the rest of the slag constituents, the slag analysis was similar to that in Example 1.

This example is an illustration of copper-zinc ore smelting yielding satisfactory results. This is an additional advantage of the invention, since such ore cannot be processed by the copper-and-sulfur smelting technique because of the high zinc content.

EXAMPLE 6

Smelting was conducted in a blast furnace of the same capacity, as in Example 1. The initial raw material is low-grade pyrite ore, containing 0.59% Cu 45.4% Fe, 50.3% S, 1.3 g/t Av and 6.3 g/t Ag. Into the furnace with a quartz layer 0.65 to 0.75 m high, a charge, containing 65.6% of the said ore 24.3% quartz and 10.1% limestone, was fed. The smelting process was conducted with 30 to 32% oxygen-enriched air blowing. The blow rate was 1,100 $m^3$/tonne of ore, the oxygen consumption herewith was 330 to 350 $m^3$/tonne of ore. The following results were obtained. The desulfurization rate was about 93%. The sulfur recovery in elemental form amounted to about 45%. The off-gas had the following analysis (%): 23.6 $SO_2$, :.11 $H_2S$, 0.23 COS, 6.8 $CO_2$, 0.27 CO and 0.6 $O_2$; the balance was nitrogen. The concentration rate was 14.2:1. The produced mattes contained 8.4% Cu, 12 g/t Au, 75 g/t Ag. The copper, gold and silver recoveries into matte were 68.5, 79.6 and 85.7%, respectively. The copper content of the slags produced was less than 0.2%.

This example illustrates processing of low-grade pyrite raw material with a precious metals content. Under the same conditions, it is possible to process lumpy (e.g. briquetted or pelletized) pyrite concentrates.

EXAMPLE 7

Smelting was carried out in a blast furnace of the same capacity, as in Example 1. The initial raw material was copper concentrate, containing 16.3% Cu 6.2% Zn, 33.9% Fe, and 36.8% S. Prior to smelting, the copper concentrate was formed into lumps, for example, by briquetting technique in a roller press using lignosulfonates (wastes from the paper and pulp industries) as a binding agent. Charge, containing 66.4% briquetted copper concentrate, 24.7% quartz and 8.9% limestone, was fed into the furnace in which a quartz layer 0.9 to 1.1 m high had been provided. The smelting process was conducted with 34% oxygen-enriched air blowing. The blow rate was 900 $m^3$/tonne of briquettes, the oxygen consumption herewith was about 300 $m^3$/tonne of briquettes. The following results were obtained. The desulfurization rate was 80.2%. The elemental sulfur recovery was 24.7%. The off-gas had the following analysis (%): 16.9 $SO_2$, 0.13 $H_2S$, 0.18 COS, 4.4 $CO_2$, 0.15 CO and 0.8 $O_2$; the balance was nitrogen. The ratio of concentration was 3.7:1. The produced mattes contained 60.3% Cu and 1.5% Zn. The slags produced contained 0.6% Cu and 5.9% Zn and could be processed to recover zinc therefrom, as well as to additionally recover some copper. As for the rest of the slag constituents, the slag analysis was similar to that in Example 1.

EXAMPLE 8

Smelting was carried out in a blast furnace of the same capacity, as in Example 1. The sulfide raw material to be treated was briquetted copper concentrate, as in Example 7. Charge of the following composition: 63.9% briquettes, 26.5% quartz and 9.6% limestone, was fed into the furnace where a quartz layer 1.3 to 1.5 m high had been provided. The smelting process was conducted with 35% oxygen-enriched air blowing. The blow rate was 950 $m^3$/tonne of briquettes, the oxygen consumption herewith was about 330 $m^3$/tonne of briquettes. The following results were obtained. The desulfurization rate was 86.4%. The elemental sulfur recovery was 25.2%. The off-gas had the following analysis (%): 17.8 $SO_2$, 0.15 $H_2S$, 0.17 COS, 4.5 $CO_2$, 0.18 CO and 0.7 $O_2$; the balance was nitrogen. The ratio of concentration was 4.9:1. The produced matte (white matte) contained 79.5% Cu and 0.3% Zn. The produced slags contained 0.8% Cu and 5.6% Zn. As for the rest of the slag constituents, the slag analysis was similar to that in Example 1. These slags could be processed to recover zinc and additional copper therefrom.

EXAMPLE 9

Smelting is carried out in a blast furnace of the same capacity, as in Example 1. The initial raw material was a pyrrhotite-type copper-nickel ore, containing 4.6% Cu, 4.3% Ni, 50% Fe and 30.3% S. Charge, consisting of 67.5% of the ore, 24.3% quartz and 8.2% limestone, was fed into the furnace where a quartz layer 1.1 to 1.3 m high had been provided. The smelting process was conducted with 30 to 32% oxygen-enriched air blowing. The blow rate was 1,000 $m^3$/tonne of ore, the oxygen consumption herewith amounted to about 300 to 32 $m^3$/tonne of ore. The following results were obtained. The desulfurization rate was 80.6%. The elemental sulfur recovery was about 11%. The off-gas had the following analysis (%): 16 $SO_2$, 0.1 $H_2S$, 0.1 COS, 5.1 $CO_2$, 0.1 CO and 0.5 $O_2$. The ratio of concentration for the total metals content was 4.74:1. The produced mattes contained 24.4% Cu and 17.8% Ni. The slags contained 0.28% Cu and 0.28% Ni. As for the rest of the slag constituents, the slag analysis was similar to that in Example 1, except for magnetite of which 4 to 5% was contained in the slags. It is possible to carry out slag cleaning, especially for nickel recovery. Thus, the reduction and sulfidization slag cleaning in an electric furnace ensured a decrease in copper down to 0.17% and in nickel down to 0.1% or less. Besides, the slag cleaning process can be accomplished at a significantly higher rate and with lower energy consumption than for slag cleaning following other autogenous processes. This is attributable to the lower (not more than 5%) magnetite content in the obtained slag.

In Examples 2 through 9, the produced mattes are transferred directly to converting for further processing.

For comparison, results of copper pyrite ore treatment by the copper-and-sulfur smelting process in accordance with U.S. Pat. No. 1,860,585 are given below. The charge consisted of 80.8% ore (containing 2.66% Cu, 38.5% Fe and 42.64% S), 11.5% quartz. 2.7% limestone and 5% of recycled slag. The smelting of this charge with a coke addition of 10% of the total charge weight was conducted in a blast furnace with a hermetically sealed throat at an air blow rate of 950 $m^3$/tonne of ore. The following results were obtained. The desulfurization rate was 85.18%. The ratio of concentration was 5.5:1. The mattes produced contained 14.6% Cu and were treated in a similar blast furnace with a sealed throat to produce mattes with a copper content of 40 to 50%, suitable for subsequent converting. The copper content of slags produced during ore smelting was 0.4%. A part of the coke fed into the furnace was consumed for the $SO_2$ reduction, and another part passed down to the bottom of the furnace and consumed oxygen supplied by air blowing, i.e. it behaved as fuel.

What is claimed is:

1. Method of treating non-ferrous sulfide raw materials in a blast furnace, which comprises autogenously smelting in a blast furnace provided with tuyeres a charge consisting of non-ferrous sulfide raw material and fluxes by blowing therein oxygen-containing gas, providing a quartz layer 0.3 to 1.5 m high immediately above the tuyeres so as to provide a sufficiently complete oxidation of iron sulfide by the oxygen contained in the oxygen-enriched blow with an oxygen consumption of 300 to 400 $m^3$/tonne of sulfide material, thereby producing matte, slag, elemental sulfur and sulfur-containing gases.

2. The method of claim 1 wherein the oxygen content in the blow is 25 to 45%.

3. The method of claim 1 wherein a carbonaceous reductant is used to improve the recovery of sulfur in elemental form.

4. The method of claim 3 wherein the reductant is natural gas introduced into the reduction zone of the furnace at a rate of 60 to 70 $m^3$/tonne of sulfide material with an injection velocity of 36 to 73 $m^3$/sec.

5. The method of claim 3 wherein the reductant is coke introduced into the furnace with the charge in an amount of 6 to 7% of the total charge weight, said amount being sufficient only for reduction of $SO_2$ to elemental sulfur.

* * * * *